United States Patent [19]

Nudd et al.

[11] Patent Number: 4,503,645

[45] Date of Patent: Mar. 12, 1985

[54] TOWER BASE ASSEMBLY

[76] Inventors: Conrad T. Nudd, 3185 Ridge Rd. W., Williamson, N.Y. 14589; Frederick A. Nudd, Jr., 4897 Arbor Rd., Walworth, N.Y. 14568

[21] Appl. No.: 493,148

[22] Filed: May 10, 1983

[51] Int. Cl.[3] ..... E04H 12/00

[52] U.S. Cl. ..... 52/40; 52/292; 52/169.5; 52/648

[58] Field of Search ..... 52/40, 292, 298, 198, 52/169.5, 697, 648, 649, 220

[56] References Cited

U.S. PATENT DOCUMENTS 1,269,326 6/1918 Slater ..... 52/40 X
1,693,107 11/1928 Campbell ..... 52/40 X
3,879,907 4/1975 Olson ..... 248/539 X
4,217,738 8/1980 Smith ..... 52/40

FOREIGN PATENT DOCUMENTS 215302 10/1957 Australia ..... 52/40

*Primary Examiner*—J. Karl Bell
*Attorney, Agent, or Firm*—Cumpston & Shaw

[57] ABSTRACT

A base for a sectional tubular tower includes a plurality of arms extending radially from a central hub and a vertically-oriented drainage tube at the end of each arm for attaching to each leg of the tower and removing moisture from the legs of such tower. The base may be a separate member or integral with the bottom of the tower.

22 Claims, 13 Drawing Figures

TOWER BASE ASSEMBLY

This invention relates in general to tubular towers such as antenna towers and more particularly to a base assembly for supporting such towers.

Antenna towers, and particularly radio and television transmission and reception towers, are often fabricated from spaced-apart upstanding tubular elements (legs) inter-connected by cross members for rigidity and strength. Such towers are frequently fabricated in sections that may be attached together to form a tower of any desired height. The tubular legs of such sections are conventionally provided with flanges at the ends thereof, both for fastening tower sections together and for anchoring the bottom section of the tower to a suitable support. While such towers may be bolted directly to a concrete base or the like, it is preferred in some instances to utilize a transition arm assembly for supporting the legs of the tower. Such an assembly includes a central hub and a plurality of arms extending therefrom, one for attachment to each tower leg. Such a transition arm assembly may be supported by a somewhat smaller concrete base than would be required for directly supporting the tower and, more importantly, may be insulated from the ground much more easily than a concrete base for directly supporting the legs of a tower.

It is a problem with towers of the type described that through leakage and/or condensation, water tends to collect in the vertical tower legs, and unless drainage is provided, degradation of the tower through rusting is likely to occur. Even more important, and particularly in the higher latitudes, water, if allowed to collect, can freeze in tower legs and such freezing may result in rupture of the tower leg and destruction of the tower. In the past as shown in FIG. 3, relatively small holes have been provided, either extending through the side walls of the tower leg or through base assembly to allow for the drainage of moisture collecting in the tower legs. Since such holes (as heretofore provided) weakened the structure of the tower, they were purposely made small, and therefore, tended to clog, thus defeating their purpose.

It is an object of this invention to provide a transition arm assembly for supporting towers having tubular legs that provides for the complete drainage of water from such legs.

It is another object of this invention to provide a complete drainage transition arm assembly that will not become clogged.

It is still another object of this invention to provide a transition arm assembly that is not weakened by providing complete drainage for the tower legs.

Briefly stated, and in accordance with a presently preferred embodiment of this invention, a draining transition arm assembly for supporting a tower having tubular legs includes a central hub having a plurality of arms extending therefrom, each arm including, at a distal end thereof, a vertically-oriented hollow tube preferably having an inner diameter equal to or greater than the inner diameter of the tower leg, each of said tubes extending through its associated arm, and preferably being provided at the upper end thereof with a flange adapted for mating with a flange at the bottom of its associated tower leg for connecting said tower to said transition arm assembly.

While this invention is particularly well suited to providing a draining transition arm assembly for use in mounting existing towers of conventional design, it is a feature of this invention that it may be incorporated as part of the lowest section of a tower without the need for a separate mounting base.

It is an unexpected advantage of this invention that not only is the drainage of moisture from the legs of a tower enhanced, but unexpectedly, the evaporation of moisture from the tower legs is enhanced by a chimney effect produced in accordance with this invention by the completely open bottom of each tower leg. In accordance with one embodiment of this invention, an auxiliary heater is provided for enhancing the chimney effect.

It is another feature of this invention that the rust treatment of tower sections and particularly the bottom tower section either adapted with a base in accordance with this invention or adapted to be fitted to a base in accordance with this invention is greatly enhanced by the completely open bottom of each of the tower legs. Tower legs of the type with which this invention is concerned are often galvanized and such galvanizing is accomplished more completely and thoroughly through the use of an open draining transition arm configuration in accordance herewith.

While the features of this invention that are believed to be novel are set forth with particularity in the appended claims, the invention itself, along with further advantages thereof, may be more completely understood by reference to the following detailed description along with the accompanying drawing, in which:

Figure 1:
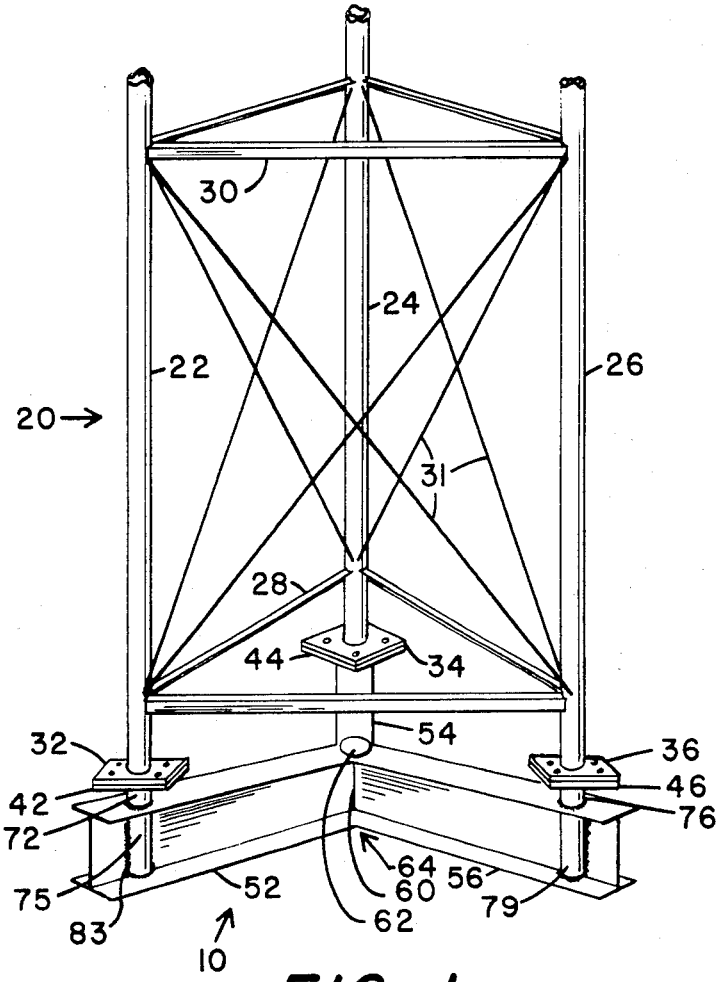
FIG. 1 is a perspective view of a draining transition arm assembly in accordance with this invention showing a tower section attached thereto.

Referring now to FIG. 1, a draining transition arm assembly 10 in accordance with this invention is illustrated with the lower portion of a tower section 20 attached thereto. Tower section 20 includes three tubular vertical legs 22, 24 and 26 maintained in spaced-apart relationship by triangular horizontal bracing members 28 and 30. While horizontal bracing members 28 and 30 are illustrated herein, it is to be understood that other forms of bracing, such as diagonal bracing members 31, may also be employed according to the requirements of a particular tower application.

Each of vertical legs 22, 24 and 26 has a connecting flange 32, 34 and 36 at the lower end thereof. Flanges 32, 34 and 36 are adapted to be fastened to mating flanges 42, 44 and 46 of transition arm assembly 10 by nuts and bolts or other suitable fasteners. Tower section 20 is conventional and as such, forms no particular part of this invention except in its unique interaction with draining transition arm assembly 10.

Transition arm assembly 10 includes a central hub 60 and three arms 52, 54 and 56, extending radially therefrom, each being constructed of suitable material such as steel for supporting the weight of the tower, and being of generally I-shaped or other rigid cross-section. The arms are joined at hub 60 by welding, bolting or the like. Preferably, plate-like upper and lower hub members 62 and 64 (not visible) are welded to the upper and lower surfaces of the inner ends of the radially extending arms to increase the strength of the transition arm assembly and also to provide a mounting area for attaching the assembly to a mounting pedestal or other base.

Vertically-oriented drainage assemblies 72, 74 (not visible) and 76 are disposed near the end of each of arms 52, 54 and 56 of transition arm assembly 10. Each drainage assembly includes a hollow tube 75, 77 (not visible) and 79 extending through one of arms 52, 54 and 56, and further includes the aforementioned flanges 42, 44 and 46, respectively, attached to the upper end of each tube. Preferably, drainage assemblies 72, 74 and 76 extend completely through or substantially through their respective arms and are rigidly attached thereto by welding, brazing or the like to maximize the strength of the connection.

Figure 2:
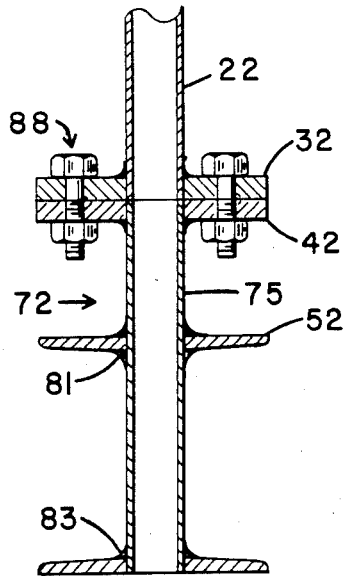
FIG. 2 is a partial sectional view of the distal end of one arm of the transition arm assembly of FIG. 1.
Figure 3:
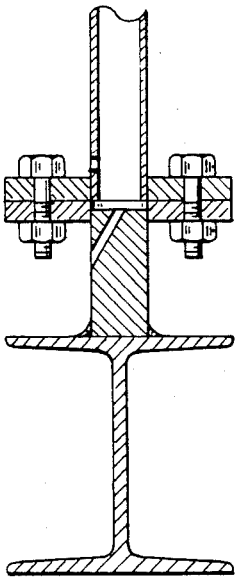
PRIOR ART FIG. 3.
FIG. 3 is a sectional view of the distal end of an arm of transition arm assembly showing drainage holes in accordance with the prior art.

The cooperation of each drainage assembly with its respective tower leg and transition arm can be seen more clearly by referring to FIG. 2 wherein a sectional view of the end portion of arm 52 and drainage assembly 72 is shown. Preferably, tubular portion 75 of drainage assembly 72 has an inside diameter at least as large as the inside diameter of tower leg 22 to provide unobstructed drainage. Flange 42 is adapted for connection to flange 32 of tower leg 22. Tube 75 extends completely through I-shaped arm 52 and is attached thereto by welds 81 and 83 at the upper and lower horizontal portions of arm 52 around the entire circumference of the tubular portions at the point where the same intersect the horizontal surfaces of arm 52, and by four straight welds 83 (one of which is visible in FIG. 1) along the lines where tube 75 intersects the surfaces of the vertical portion of arm 52. As has been described, tower leg 20 and transition arm assembly 10 are preferably connected by bolts 88 extending through flanges 32 and 42 of arm 52 and leg 22 respectively, and the corresponding flanges of the remaining arms and legs as illustrated in FIG. 1 only.

Figure 4:
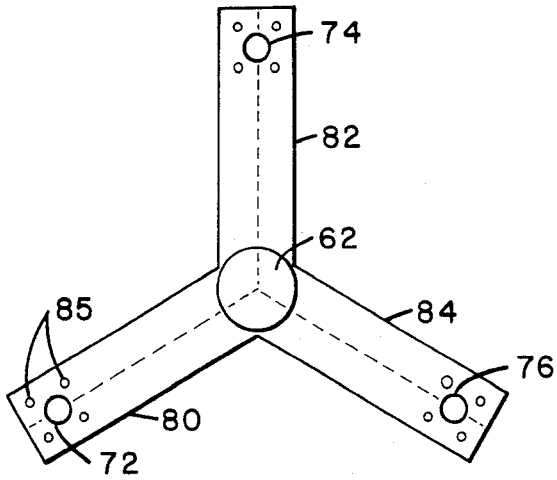
FIG. 4 is a top view of a draining transition arm assembly in accordance with an alternative embodiment of this invention.
Figure 5:
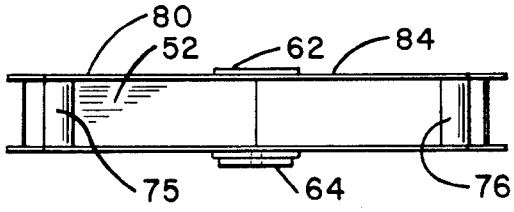
FIG. 5 is a side view of the embodiment of this invention shown in FIG. 4.

Referring now to FIGS. 4 and 5, and alternative embodiment of a draining transition arm assembly in accordance with this invention is illustrated in top and side views, respectively. Flanges 42, 44 and 46 of the embodiment shown in FIGS. 1 and 2 are eliminated and tubular portions 72, 74 and 76 terminate at the upper surface of arms 80, 82 and 84. A plurality of mounting holes 85 is provided in the upper surface of each arm for mating with corresponding holes in flanges 32, 34 and 36 of the lower tower section as shown in FIG. 1. Upper and lower hub members 62 and 64, as described in connection with FIGS. 1 and 2, maybe provided.

Figure 6:
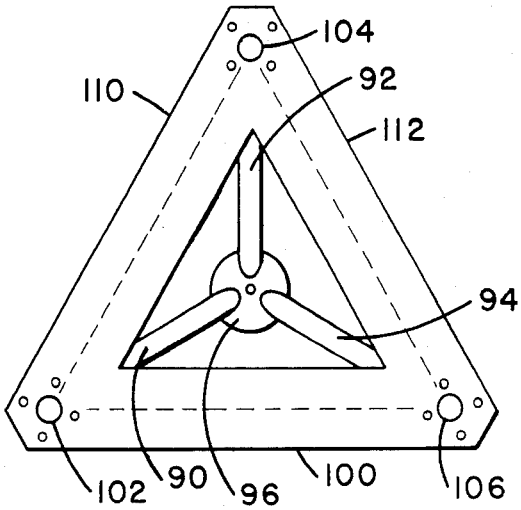
FIGS. 6 and 7 are a top view and a side view, respectively, of a draining transition arm assembly in accordance with another embodiment of this invention.
Figure 7:
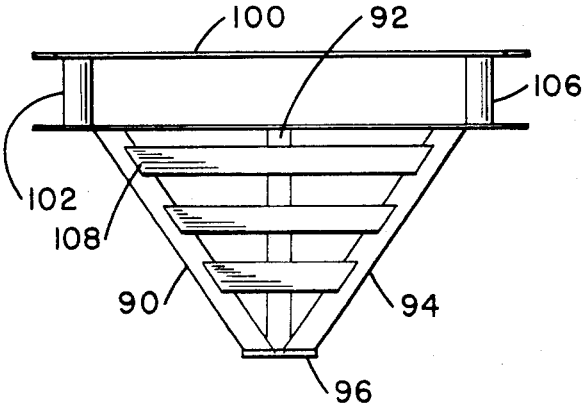

FIGS. 6 and 7 show top and side views of yet another alternative embodiment of this invention having an inverted pyramidal shape. A plurality of inclined tubular supports 90, 92 and 94 connect a lower mounting plate 96, adapted to be mounted on a mounting pedestal, to an upper triangular tower support member 100. Tubular drainage elements 102, 104 and 106 extend through and attached to the I-shaped elements of triangular support 100 at or near the verticies thereof, in a manner similar to tube 75 of the structure shown in FIG. 2. While tubes 102, 104 and 106 are shown terminating at the upper surface of triangular support 100, it will be understood by those skilled in the art that the raised construction and flanges illustrated in FIGS. 1 and 2 may also be employed if desired. Tubes 102, 104 and 106 extend through support member 100 to provide the open draining function of this invention. Preferably, bracing elements 108 are connected between adjacent ones of arms 90, 92 and 94 for increasing the strength of the base.

Figure 8:
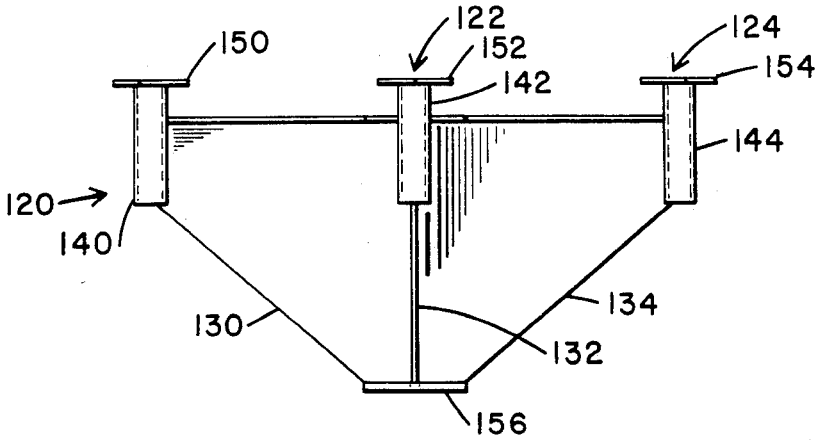
FIG. 8 is a side view of a draining transition arm in accordance with yet another embodiment of this invention.

Referring now to FIG. 8, still another embodiment of the invention is illustrated in side elevation wherein drainage assemblies 120, 122 and 124 are disposed at the ends of truncated triangular-shaped arms 130, 132 and 134. Each of the arms is generally T-shaped in cross-section including a vertical web portion attached to a vertical tubular drainage portions 140, 142 and 144 of each drainage assembly, for example by welding or the like. Each drainage assembly includes an upper flange 150, 152 and 154 adapted to mate with a corresponding flange at the lower end of each tower leg mounted on the transition arm assembly. A base 156 is preferably provided for mounting to a pedestal or the like as has been heretofore discussed.

Figure 9A:
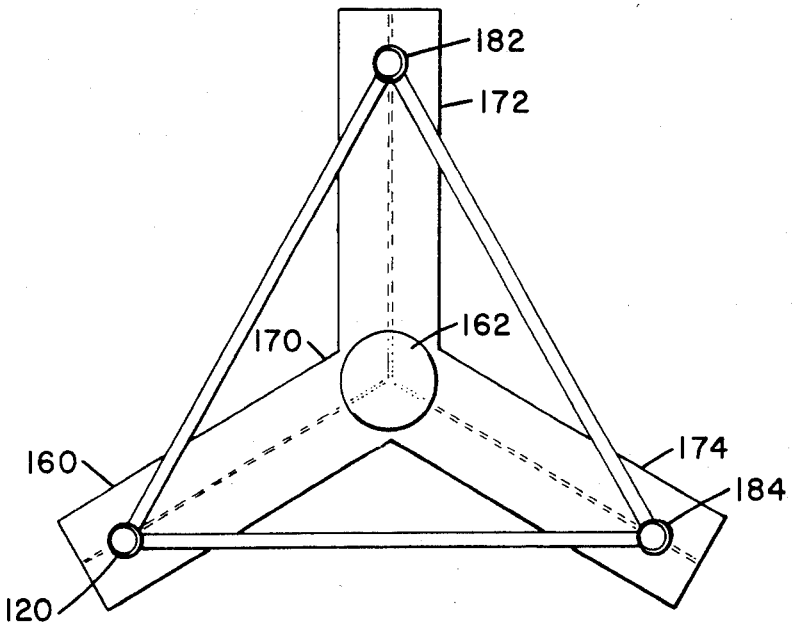
FIGS. 9A and 9B are a top view and a side view, respectively, of a tower section having an integral draining transition arm assembly in accordance with this invention.
Figure 9B:
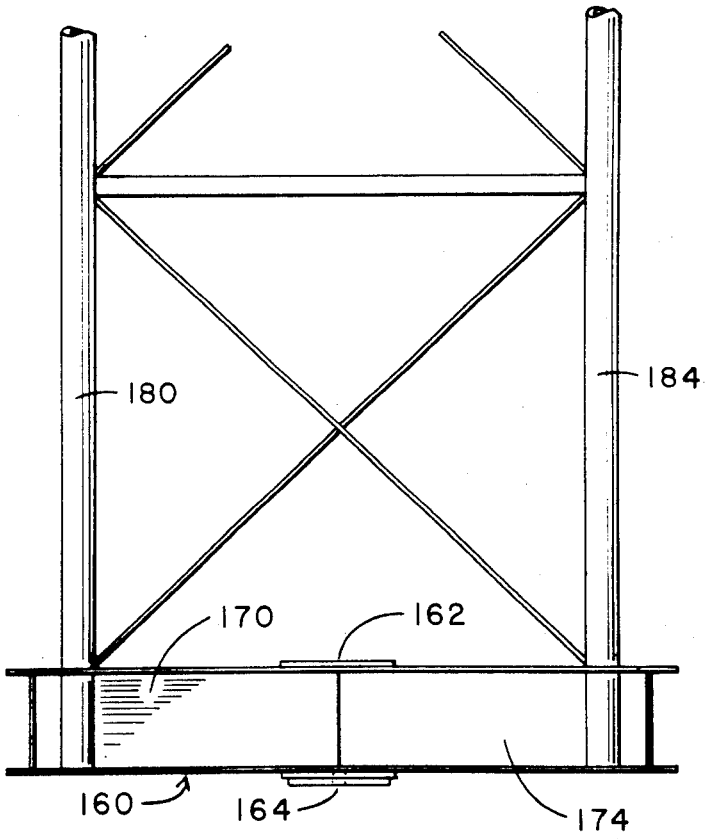

Referring now to FIGS. 9A and B, an embodiment of the invention integral with a tower section is illustrated in top and side views. The base 160 includes a central hub including plates 162 and 164 and arms 170, 172 and 174 extending radially therefrom in a manner substantially similar to that shown in the embodiment of FIGS. 4 and 5. Each of the arms receives the lower portion of one of the tower legs 180, 182 and 184 therethrough and is connected thereto by welding or the like as has been hereinabove discussed. The vertical tower legs extend completely through each of the arms and provide the same completely open drainage path provided in each of the other embodiments of this invention.

Figure 12:
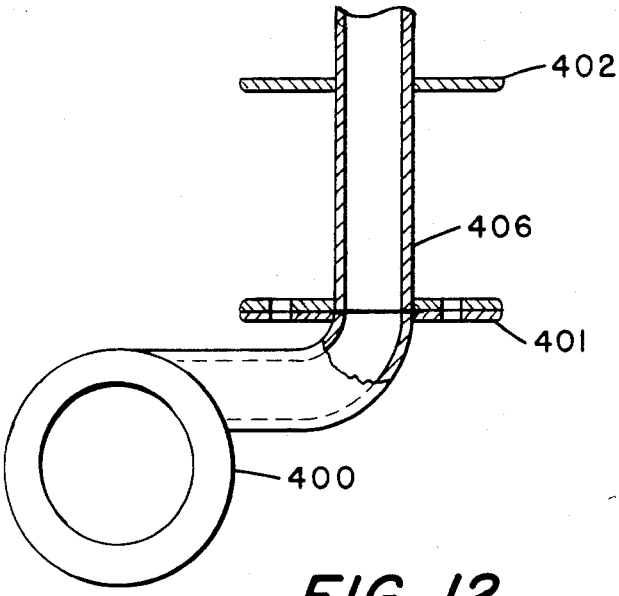
FIG. 12 is a section view of a portion of a transition arm assembly in accordance with this invention.

An alternative means for generating a source of heated air is illustrated at FIG. 12 wherein a source of heated air represented schematically by blower 400 and powered by electricity or gas or some other power source, is coupled to the bottom of drainage assembly 200. Blower 400 provides flow of heated air from the bottom of the tower leg to the top enhancing the chimney effect heretofore described.

Figure 10:
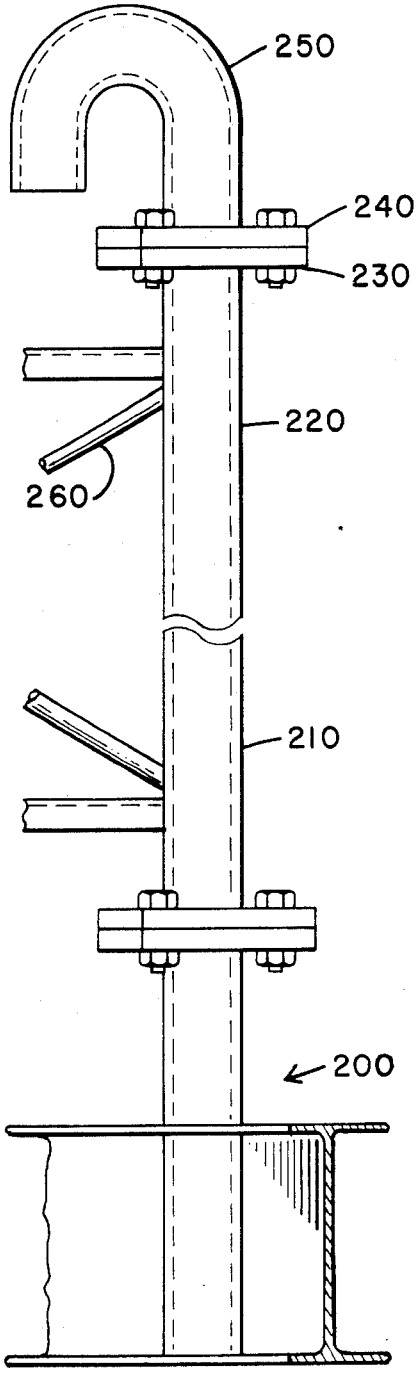
FIG. 10 is an oblique side view of a leg of a tower attached to a transition arm assembly in accordance with this invention.

Referring now to FIG. 10, a portion of one end of an arm of a transition arm assembly substantially identical to that shown in FIGS. 1 and 2 is illustrated and designated generally as arm 200. Arm 200 is attached to a leg 210 of a tower. Upper portion 220 of leg 210 includes a flange 230 coupled to a mating flange 240 at the bottom end of a substantially U-shaped cap member 250. Portions of diagonal bracing members 260 are also visible in FIG. 10. Cap 250 includes a U-shaped upper portion open at the end thereof to allow rising hot air to escape or vent from the top of leg 210 while preventing rain water or debris from entering the tower leg. The structure of FIG. 10 enhances the chimney effect heretofore described and improves natural drying of the inside of tower leg 220.

Figure 11:
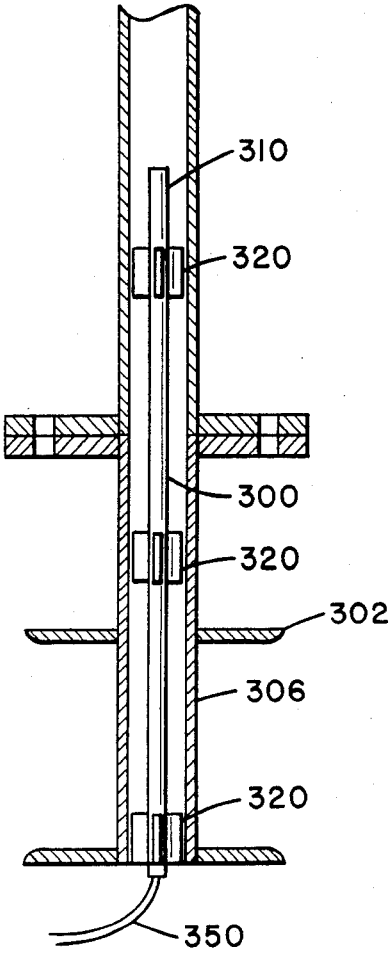
FIG. 11 is a section view of a portion of leg of a tower and a portion of a transition arm assembly in accordance with this invention.

FIG. 11 shows, in cross-section, the drainage assembly of arm 200 and the lower portion of leg 210 and further includes a heater 300 within drainage assembly 200 and extending at least partially into leg 210. It will be understood that, if desired, heater 300 may be confined wholly in transition arm assembly 200.

Heater 300 is of any conventional type and includes a heating element 310 supported by a plurality of spacers 320 adapted to engage heater element 310 and the inner walls of drainage tube 306. Preferably, heater element 310 is an electrical heater element and is connected to an appropriate power source by cable 350. Through the use of heater 310, a continuous flow of warm air is created in each tower leg for preventing ice build-up on the outside of the leg and drying the inside of the leg. The load on the tower is thereby reduced, rusting is inhibited and tower life is greatly extended.

While certain presently preferred embodiments of the invention have been illustrated, those skilled in the art will recognize that many modifications and changes can be made thereto without departing from the true spirit and scope of the invention which is intended to be defined solely by the appended claims.

We claim:

1. A draining transition arm assembly for supporting a tower having one or more vertically-oriented tubular legs comprising:
   - a central hub;
   - a plurality of generally horizontal arms extending radially outward from said central hub;
   - a drainage assembly on each arm, each assembly including a substantially vertically-oriented tube open at both ends and extending substantially through and attached to said arm; and means at the upper end of each tube for attaching said tubular legs to said drainage assembly.

2. The transition arm assembly of claim 1 wherein each of said vertically-oriented tubes is characterized by an inside diameter greater than or equal to the inside diameter of said tubular legs.

3. The transition arm assembly of claim 1 wherein each of said tubes extends through and above said arms and includes a flange attached thereto said flanges being spaced above an upper surface of said arms.

4. A base assembly for supporting a tower having one or more tubular legs comprising:
   - a base member having a first surface adapted to engage a flange on said leg;
   - a vertically-oriented tube, open at both ends and aligned with said leg extending through said first surface and for providing a substantially unobstructed vertical drainage path from said leg through said surface.

5. The base assembly of claim 4 wherein said tube extends above said first surface, and further comprising a flange attached to said tube for engaging a flange on said leg.

6. The base assembly of claim 4 wherein said tube is characterized by an inside diameter at least as large as the inside diameter of said legs.

7. The base assembly of claim 5 wherein said tube is characterized by an inside diameter at least as large as the inside diameter of said legs.

8. The base assembly of claim 4 comprising means for heating the air in said tubes.

9. The base assembly of claim 8 wherein said heating means are contained within said tubes.

10. The base assembly of claim 8 comprising means for following air onto said tubes.

11. A transition arm assembly for mounting a tower having a plurality of tubular legs comprising;
   - a central hub;
   - a plurality of arms extending from said central hub;
   - a plurality of drainage assemblies, one at the end of each arm, and each including a vertically-oriented tubular portion extending substantially through said arm, providing a substantially vertical drainage path from said leg and means for coupling each of said legs to said arms with said legs aligned with said drainage assemblies.

12. The transition arm assembly of claim 11 wherein said arms are generally I-shaped in cross-section.

13. The transition arm assembly of claim 11 wherein each of said drainage assemblies comprises a vertically-oriented tube attached to and extending substantially through said arm and means at the upper end of said tube for attaching to said leg.

14. In a tower having at least two tubular legs an improved base comprising;
   - a central hub;
   - an arm connecting each of said legs to said hub;
   - means at the distal end of each arm for connecting said arm to one of said legs and providing a substantially open vertical drain for removing moisture from said leg.

15. The base of claim 14 wherein said arms are disposed substantially perpendicular to said legs.

16. The base of claim 14 wherein said limb is disposed substantially centrally of said legs.

17. The base of claim 14 wherein said arms are disposed at an angle of between 45° and 90° relative to said legs.

18. The base of claim 14 wherein said arms are removably attached to said legs.

19. The base of claim 14 wherein said arms are permanently attached to said legs.

20. The base of claim 19 wherein said arms are welded to said legs.

21. The base of claim 14 wherein each of said arms includes a leg coupling member comprising a vertically-oriented drainage tube on said arm and coupling means for connecting an end of each of said legs to said tube.

22. The base of claim 20 wherein each of said legs includes a flange and said coupling means comprises a mating flange.

* * * * *

UNITED STATES PATENT AND TRADEMARK OFFICE

CERTIFICATE OF CORRECTION

PATENT NO. : 4,503,645

DATED : March 12, 1985

INVENTOR(S) : Conrad T. Nudd and Frederick A. Nudd, Jr.

It is certified that error appears in the above-identified patent and that said Letters Patent is hereby corrected as shown below:

Claim 10, column 6, line 14, delete "following" and insert --blowing--.

Signed and Sealed this

*Twenty-ninth* Day of *July 1986*

[SEAL]

*Attest:*

DONALD J. QUIGG

*Attesting Officer*

*Commissioner of Patents and Trademarks*